US007128627B2

(12) United States Patent
Ferguson

(10) Patent No.: US 7,128,627 B2
(45) **Date of Patent: *Oct. 31, 2006**

(54) MARINE STEERING SYSTEM HAVING SWIVEL BRACKET FORMING HYDRAULIC CYLINDER

(75) Inventor: Arthur R. Ferguson, Glenview, IL (US)

(73) Assignee: Teleflex Canada Incorporated, Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/693,689

(22) Filed: Oct. 27, 2003

(65) Prior Publication Data

US 2004/0154517 A1 Aug. 12, 2004

Related U.S. Application Data

(63) Continuation-in-part of application No. 10/133,647, filed on Apr. 29, 2002, now Pat. No. 6,761,599.

(51) Int. Cl.
*B63H 5/125* (2006.01)

(52) U.S. Cl. ..... 440/615; 114/144 R; 440/53

(58) Field of Classification Search ..... 440/53, 440/900, 62; 114/144 R, 615
See application file for complete search history.

(56) References Cited

U.S. PATENT DOCUMENTS 3,774,568 A * 11/1973 Borst et al. ..... 114/144 R
6,276,977 B1 * 8/2001 Treinen et al. ..... 440/61 R
6,761,599 B1 * 7/2004 Ferguson ..... 440/61 S

* cited by examiner

*Primary Examiner*—Ed Swinehart
(74) *Attorney, Agent, or Firm*—Baker & Hostetler LLP

(57) ABSTRACT

A steering apparatus for a marine craft has a first bracket connectable to the stern of the marine craft. There is a second bracket connectable to the propulsion unit of the marine craft. The second bracket is rotatably connected to the first bracket for relative rotation about an axis of rotation. The propulsion unit can be rotated about the axis of rotation relative to the stern of the craft. The second bracket has a cylindrical bore extending therethrough. A piston is reciprocatingly received within the bore. The piston slidingly engages the bore and has a piston rod connected thereto. The piston rod is operatively connected to the propulsion unit. In an alternative embodiment a cable replaces the piston and is slidably received by a cable tube extending through end fittings in the bore.

11 Claims, 5 Drawing Sheets

MARINE STEERING SYSTEM HAVING SWIVEL BRACKET FORMING HYDRAULIC CYLINDER

CROSS-REFERENCE TO RELATED APPLICATIONS AND CLAIM TO PRIORITY

This is a continuation in part of application Ser. No. 10/133,647 of Arthur R. Ferguson for the invention entitled Marine Steering system Having Swivel Bracket Forming Hydraulic Cylinder, filed Apr. 29, 2002 now U.S. Pat. No. 6,761,599, the disclosure of which is incorporated herein by reference and priority to which is claimed under 35 U.S.C. § 120.

BACKGROUND OF THE INVENTION

This invention relates to hydraulic steering systems for marine craft, and more particularly for marine craft having outboard drives or inboard/outboard drives.

Smaller marine craft are typically powered by outboard drive units or inboard/outboard drive units which are mounted on the transom of the marine craft at the stem. The drive units can be tilted upwards about a horizontal axis of rotation for storage purposes, in shallow water, to perform maintenance operations or for other such purposes. The drive unit is usually mounted on a swivel bracket which allows the drive unit to be tilted upwards. The drive units can be rotated about a steering axis relative to the swivel bracket.

In some such marine craft, a hydraulic steering system is provided in order to rotate the drive unit about the steering axis. Various systems have been developed in the past which permit the drive units to be tilted upwards when so equipped with hydraulic steering systems.

For example, U.S. Pat. No. 6,276,771 to Treinen et al. discloses an integrated hydraulic steering actuator where the tilt bracket has a cylindrical portion. A hydraulic actuator, comprising a cylinder member and a piston member, are disposed within the cylindrical portion of the tilt bracket. However this arrangement has a number of disadvantages. For example, the assembly has a relatively large number of parts. The tilt bracket has a cylindrical portion with a cylindrical bore. Both an inner cylinder and an outer cylinder are disposed within the bore. A piston of a piston and piston rod assembly is reciprocatingly and slidingly received within the inner cylinder. The relatively large number parts increases to the cost of components as well as the assembly time and accordingly may increase the cost of the overall system. Furthermore, where different metals are used for the various components, such as the inner cylinder, the outer cylinder and the cylindrical portion of the tilt bracket, corrosion problems can result in a marine environment.

Accordingly is an object of the invention to provide an improved hydraulic steering system for marine craft having stern drives, where non-rotational travel of the hydraulic actuator is effectively eliminated when the stern drive is tilted, but which offers simpler construction and requires fewer parts than the prior art.

It is another object of the invention to provide an improved hydraulic steering system for marine craft where non-rotational travel of the hydraulic actuator is effectively eliminated when the stern drive is tilted, but which does not acquire a separate hydraulic cylinder, apart from the swivel bracket, to support the pivotal connection between the swivel bracket and the transom bracket.

Is further object of the invention to provide an improved hydraulic steering system for marine craft where non-rotational travel of the hydraulic actuator is effectively eliminated when the stern drive is tilted, and where potential corrosion between the steering cylinder and a tilt bracket is eliminated by forming the cylinder as part of the tilt bracket.

BACKGROUND OF THE INVENTION

According to the invention, there is provided a steering apparatus for marine craft having a stern and a propulsion unit mounted on the stern. The system includes a first bracket which is connectable to the stern of the marine craft. There is a second bracket connectable to the propulsion unit. The second bracket is rotatably connected to the first bracket for relative rotation about an axis of rotation. The propulsion unit can be rotated about the axis of rotation relative to the stern of the craft. The second bracket has a cylindrical bore extending therethrough. A piston is reciprocatingly received within the bore, slidingly engages the bore and has a piston rod connected thereto. The piston rod is operatively connected to the propulsion unit. Preferably the piston rod is coaxial with the axis of rotation.

In one example, the second bracket has an actuator portion. The bore extends through the actuator portion. The second bracket comprises a cylinder for the actuator. The actuator portion may have a cylindrical bushing surface. The first bracket has an extension. The extension has a cylindrical bore rotatably receiving the bushing surface. The bushing surface and the cylindrical bore are co-axial with the axis of rotation.

The invention offers significant advantages over the prior art. It provides a hydraulic steering system for stern drives where there is no arcuate travel of the hydraulic actuator when the stern drive is tilted. At the same time, it significantly reduces the complexity of the mechanism compared to U.S. Pat. No. 6,276,977 because it does not require a separate outer or inner cylinder apart from a bore through the swivel bracket itself. In effect, a portion of the swivel bracket becomes the cylinder of the actuator.

Nor is it feasible to readily modify the above U.S. patent to delete the inner and outer cylinders. This is because the extensions to the clamp brackets are beside the cylindrical portion of the swivel bracket which therefore does not present a continuous cylindrical bore for a cylinder. Furthermore, the outer cylinder is required in order to act as a pin in the hinged connection between the extensions to the clamp brackets and the cylindrical portion of the swivel bracket.

Corrosion cannot occur between the hydraulic cylinder and the tilt bracket according to the invention because they comprise a single component in the preferred embodiment.

DETAILED DESCRIPTIONS OF THE PREFERRED EMBODIMENTS

Figure 8:
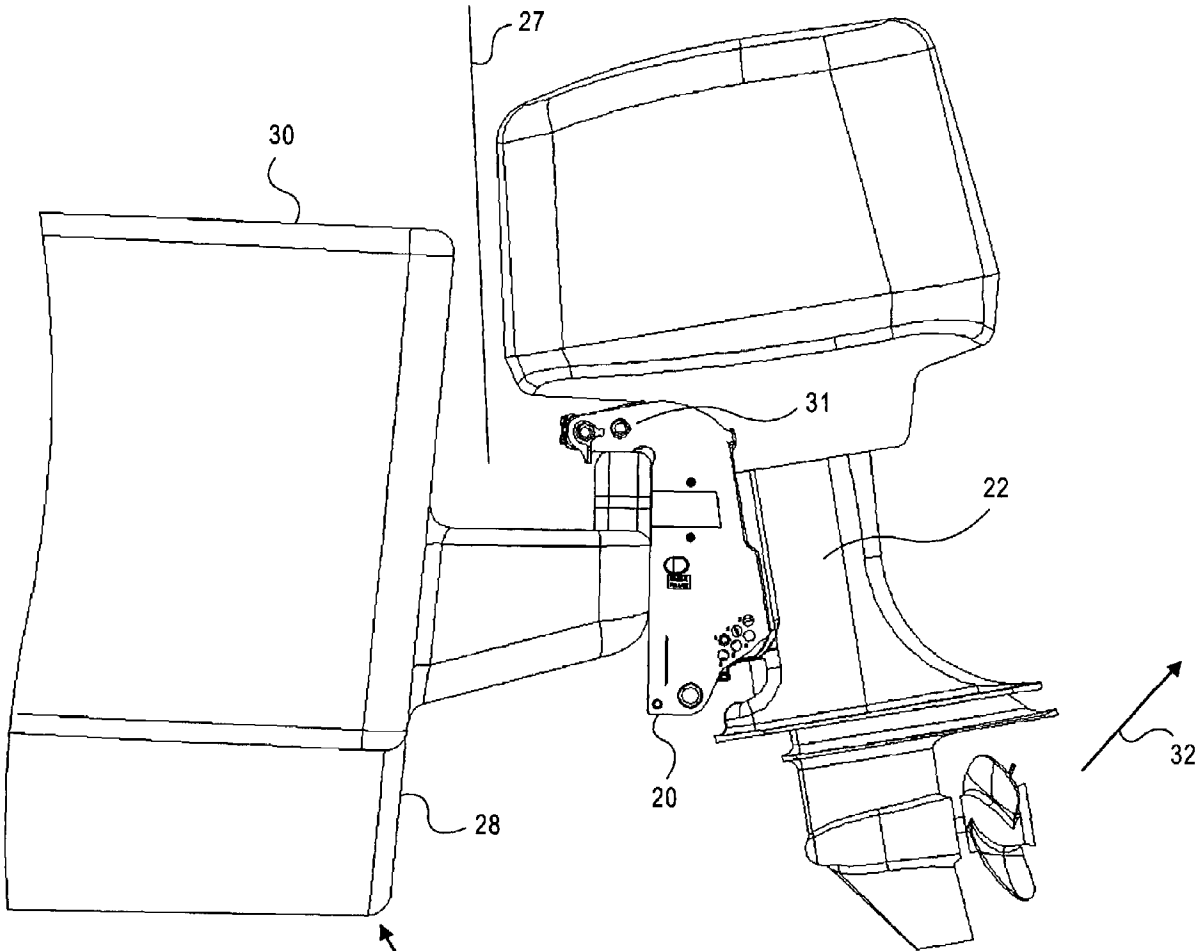
FIG. 8 is a fragmentary, side elevational view of the stern portion of a marine craft with an outboard motor mounted thereon and a steering system according to the embodiment of FIG. 1.

Referring to the drawings, and first to FIG. 8, this shows a hydraulic steering apparatus 20 used in conjunction with an outboard motor 22 which is mounted on transom 28 at stern 30 of a boat 26. The steering apparatus is used to steer the boat by rotating the motor about steering axis 27. However the steering apparatus allows the motor to be rotated upwardly from the normal operating position shown about a generally horizontal axis of rotation 31 as indicated by arrow 32. It should be understood however that the invention is also applicable to other types of stern drives, such as inboard/outboard drives.

Figure 1:
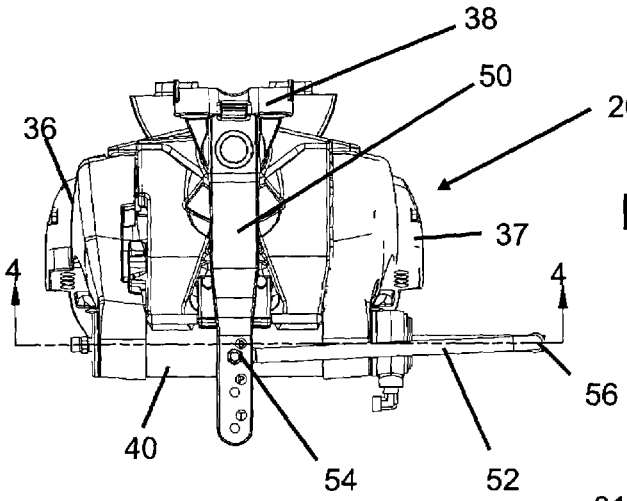
FIG. 1 is a top plan view of the steering system for a marine craft according to an embodiment of the invention.
Figure 2:
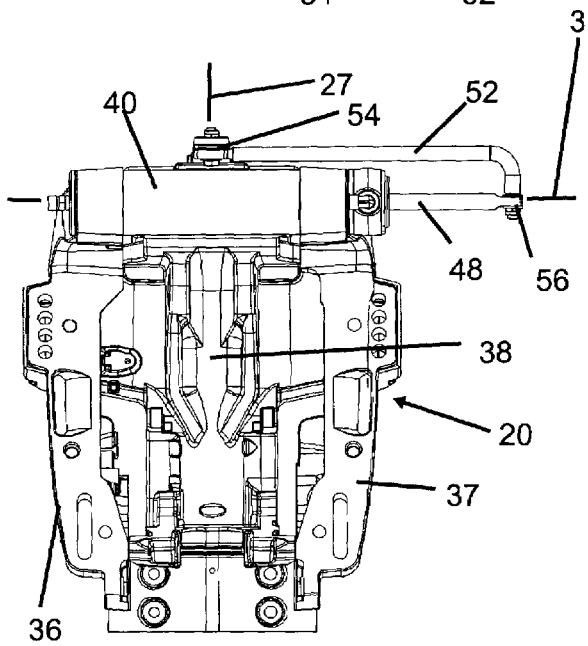
FIG. 2 is a front view thereof.
Figure 3:
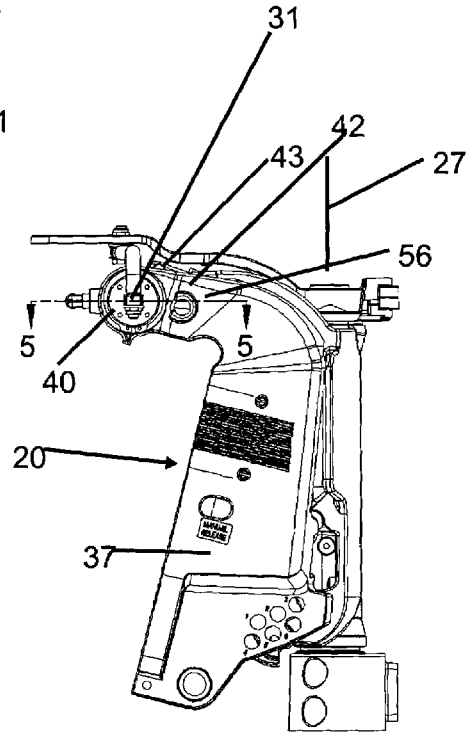
FIG. 3 is a side elevation thereof.

Referring to FIGS. 1–3, these show the steering apparatus 20 in more detail. The apparatus includes a pair of first or stern brackets 36 and 37 which are connected to a second or swivel bracket 38 so as to permit rotation of the motor about the axis of rotation 31. In an alternative embodiment the stern brackets are combined into a single bracket. The swivel bracket has a cylinder-like actuator portion 40 forming part of the bracket and adjacent top 42 thereof. There is a position sensor 43 mounted on the top of the swivel bracket.

Figure 4:
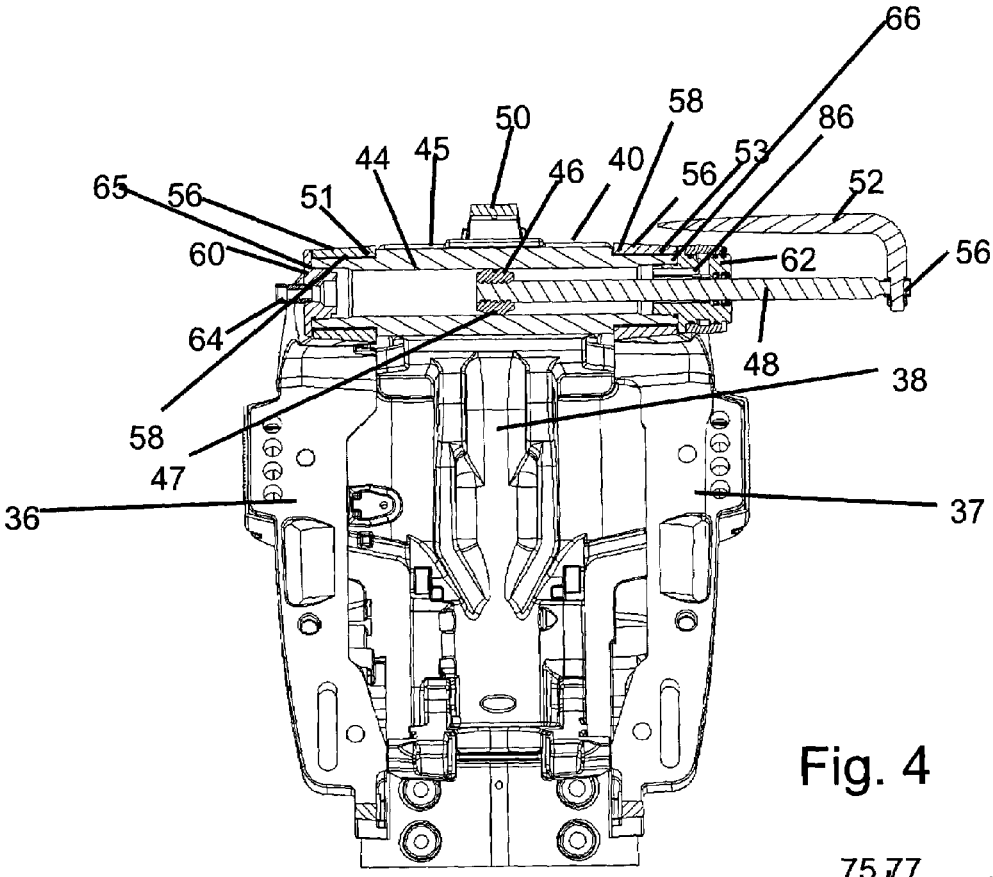
FIG. 4 is an enlarged front view, similar to FIG. 2, with the actuator thereof and steering arm thereof shown in section along line 4—4 of FIG. 1.

Referring to FIG. 4, the actuator portion 40 of the swivel bracket has a cylindrical bore 44 extending therethrough and thereby forms the cylinder for a hydraulic actuator 45. A piston 46, equipped with sealing ring 47, is reciprocatingly received within the bore and slidingly engages the bore. There is a piston rod 48 connected to the piston. The piston rod is connected to steering arm 50 by a link arm 52 having pivotal connections 54 and 56 to steering arm and piston rod respectively as seen in FIGS. 1 and 4. Thus the piston rod is operatively connected to the propulsion unit which is mounted on the swivel bracket 38. The piston rod in this embodiment is coaxial with the axis of rotation 31.

Referring again to FIG. 4, actuator portion 40 has a pair of spaced apart cylindrical bushing surfaces 51 and 53 on the outside thereof. Each of the stern brackets 36 and 37 has an upper extension 56, shown in FIGS. 3 and 4, each having a cylindrical bore 58 which rotatably receives one of the bushing surfaces 51 or 53. The bushing surfaces and the cylindrical bores in this embodiment are coaxial with the axis of rotation 31.

The actuator 45 includes threaded end fittings 60 and 62 with O-rings 65 and 66 respectively which sealingly engage opposite ends of the actuator portion 40 so as to seal the opposite ends of the bore 44. Fitting 60 is provided with a hydraulic fitting 64 for the passage of hydraulic fluid into and out of the portion of the actuator to the left of the piston, from the point of view of FIG. 4.

Figure 5:
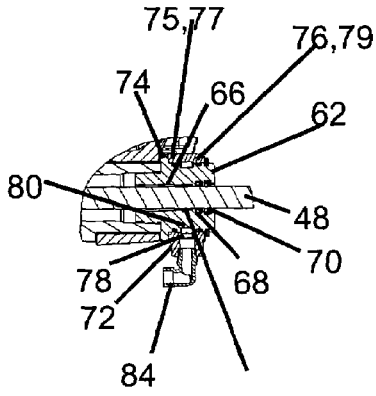
FIG. 5 is a sectional view along line 5—5 of FIG. 3.

Referring to FIG. 5, end fitting 62 has an aperture 66 extending therethrough with bushing 73 mounted in the aperture. The piston rod 48 extends through bushing 73 and sealingly through the aperture by means of seal 68 and wiper 70 mounted on the end fitting about the aperture 66. There is a swivel member 72 rotatably mounted on the end fitting 62 between bushing 74 and retaining ring 76. The swivel member is annular in shape and has an inner, annular groove 78 which coincides with a similar, annular groove 80 in the end fitting. The two grooves form an annular hydraulic conduit which allows hydraulic fluid to pass between hydraulic fitting 84 and passageway 86 in the end fitting 62 as shown in FIG. 4. Two annular grooves 75 and 76 with O-rings 77 and 79 respectively, seal the annular hydraulic conduit. This permits the actuator 45 to rotate about the axis 31 without displacing the hydraulic fitting 84.

Figure 6:
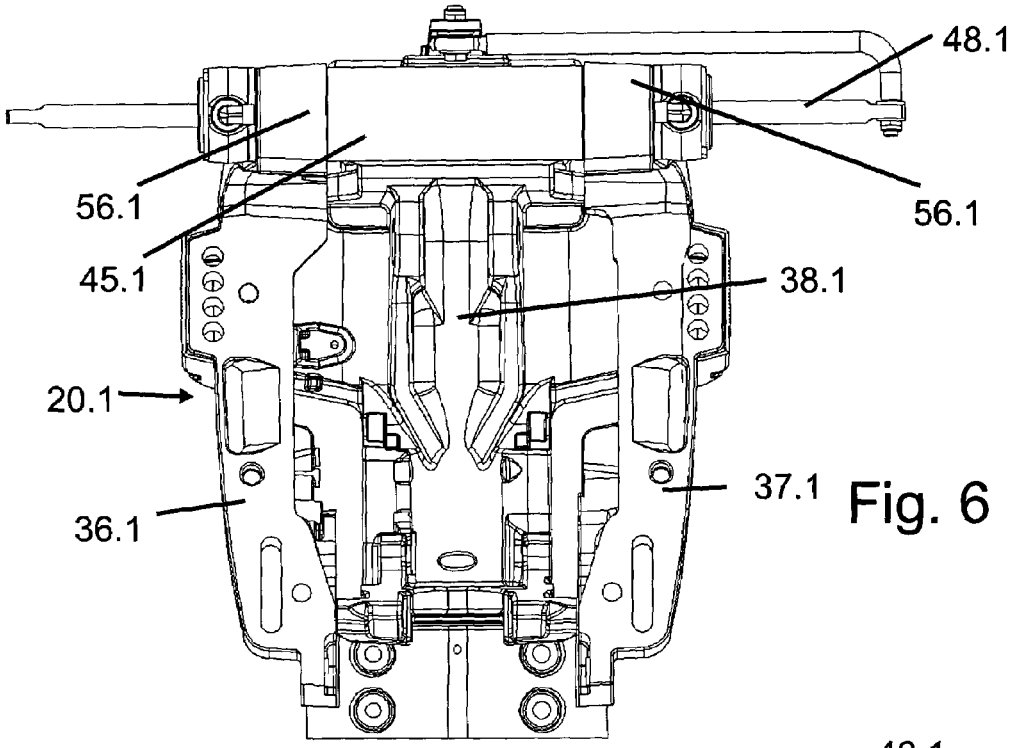
FIG. 6 is a view similar to FIG. 2 of an alternative embodiments with a double acting actuator.
Figure 7:
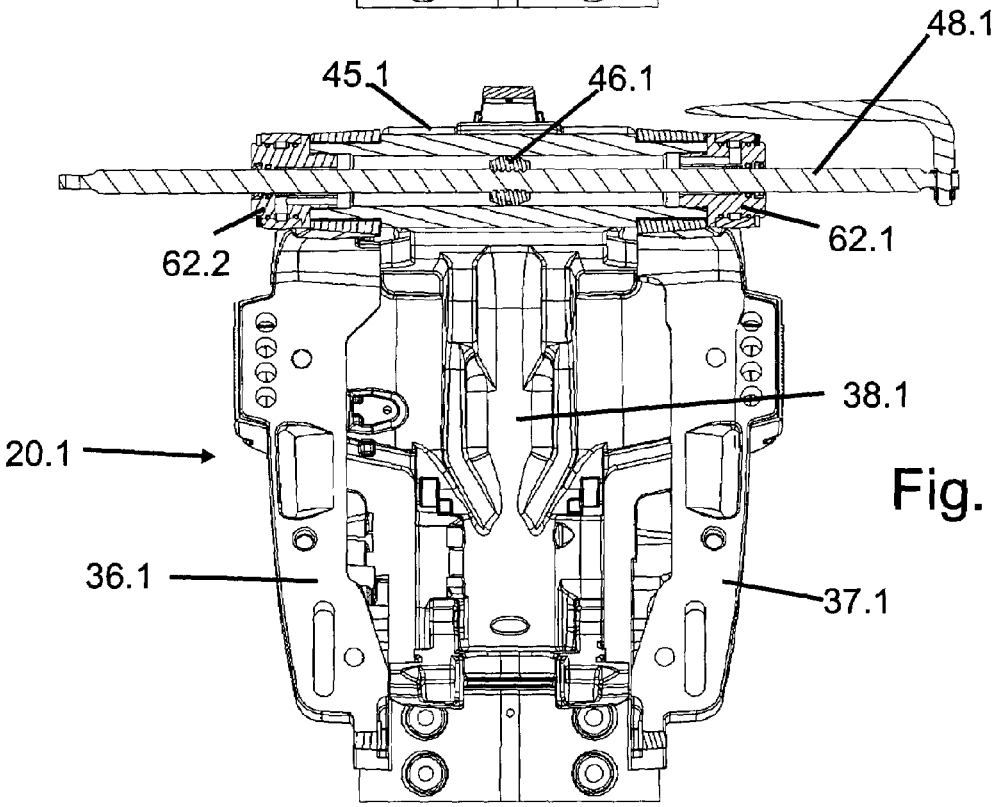
FIG. 7 is a view thereof equivalent to FIG. 4.

FIGS. 6 and 7 show an alternative embodiment were like parts have like numbers with the addition of "0.1". In this embodiment however actuator 45.1 is double acting and piston rod 48.1 extends on both sides of the piston 46.1. Therefore, in this case, there is a hydraulic fitting 62.2, which is a mirror image of the fitting 62 of the previous embodiment, at the end of the actuator opposite to fitting 62.1.

Figure 9:
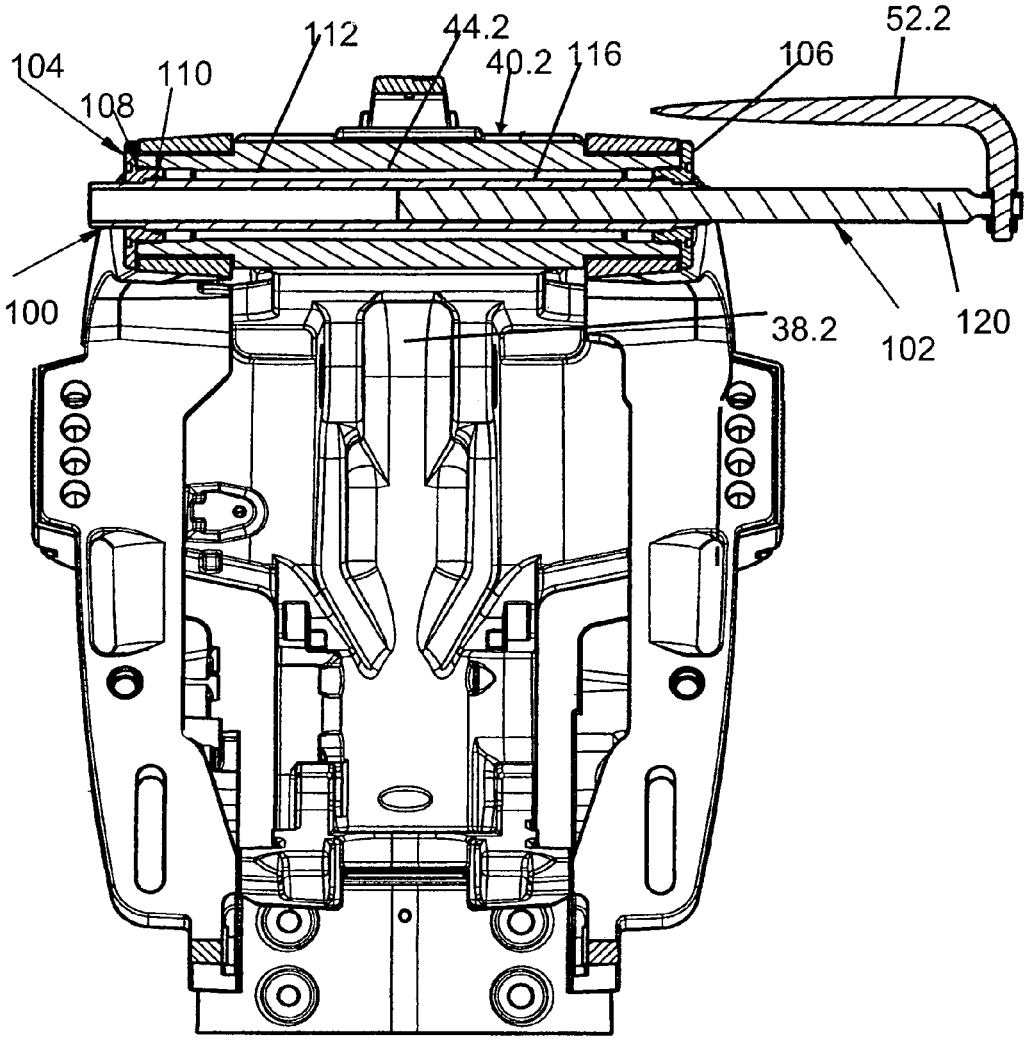
FIG. 9 is a view similar to FIG. 4, showing an alternative embodiment for a mechanical steering system.

With reference to FIG. 9, this shows an alternative embodiment for use with a mechanical steering system utilizing cables to connect the outboard motor to the helm. Like parts have like numbers as in the previous embodiments with the addition of "0.2". This embodiment is generally similar to the previous ones, so is described only in relation to the differences. The actuator portion 40.2 of the swivel bracket does not comprise a hydraulic actuator as in the previous embodiments. Instead, the swivel bracket 38.2 has a steering cable tube 100 which mounts a steering cable 102, only the rod end portion of the cable being shown. The steering cable tube is held laterally and concentrically with the tilt axis by end fittings 104 and 106 which replace the end fittings used in the hydraulic steering versions. The end fittings are sealed to the swivel bracket by O-rings 108 and 110, shown only for end fitting 104, but present on both end fittings, to prevent water from entering space 112 between the cylindrical bore 44.2 in the swivel bracket and outside 116 of the steering cable tube. End 120 the steering cable is connected to link arm 52.2 which connects to the steering arm.

In the embodiment of FIG. 9, the cylindrical bore 44.2 is the same diameter as bore 44 in the embodiment of FIG. 4. The end fittings 104 and 106 are interchangeable with the end fittings 60 and 62 of the embodiment of FIG. 1 so that the embodiment of FIG. 9 can be converted to a hydraulic steering system by removing the end caps 104 and 106 along with the cable tube and cable and replacing them with the hydraulic components shown in either FIG. 4 or FIG. 6.

It will be understood by someone skilled in the art that many the details provided above are by way of example only and are not intended to limit the scope of the invention which is to be interpreted with reference to the following claims:

What is claimed is:

1. A steering apparatus for a marine craft having a stern and a propulsion unit mounted on the stern, the system comprising:

a first bracket connectable to the stern of the marine craft; and a second bracket connectable to the propulsion unit, the second bracket being rotatably connected to the first bracket for relative rotation about an axis of rotation, whereby the propulsion unit can be rotated about the axis of rotation relative to the stern of the craft, the second bracket having a cylindrical bore extending therethrough, a piston being reciprocatingly received within the bore, slidingly engaging the bore and having a piston rod connected thereto, the piston rod being operatively connected to the propulsion unit, wherein the piston rod is coaxial with the axis of rotation, wherein the second bracket has an actuator portion, the bore extending through the actuator portion, whereby the second bracket comprises a cylinder for the actuator, and wherein the actuator portion has a cylindrical bushing surface, the first bracket having an extension, said extension having a cylindrical bore rotatably receiving the bushing surface, the bushing surface and the cylindrical bore being coaxial with the axis of rotation.

2. The steering apparatus as claimed in claim 1, including a pair of first brackets, the actutator portion having a pair of spaced apart cylindrical bushing surfaces, each of the first brackets having an extension with a cylindrical bore rotatably receiving one of the bushing surfaces.

3. The steering apparatus as claimed in claim 2, wherein the bushing surfaces and the cylindrical bores are coaxial with the axis of rotation.

4. The steering apparatus as claimed in claim 1, including end fittings sealingly engaging opposite ends of the bore in the second bracket, the end fittings each having a hydraulic connector for connecting a hydraulic conduit to the second bracket.

5. The steering apparatus as claimed in claim 4, wherein at least one of the end fittings has an aperture therethrough, the piston rod extending sealingly through the aperture, said at least one end fitting having a swivel member rotatably mounted thereon, one of the hydraulic connectors being mounted on the swivel member, whereby the second bracket can rotate relative to said one hydraulic connector.

6. The steering apparatus as claimed in claim 5, wherein said one of the end fittings has a cylindrical outer surface, the swivel member having a cylindrical opening rotatably receiving the cylindrical outer surface.

7. The steering apparatus as claimed in claim 6, including an annular hydraulic conduit extending between the cylindrical outer surface and the cylindrical opening.

8. A steering apparatus for a marine craft having a stern and a propulsion unit mounted on the stern, the system comprising:

a first bracket connectable to the stern of the marine craft; and a second bracket connectable to the propulsion unit, the second bracket being rotatably connected to the first bracket for relative rotation about an axis of rotation, whereby the propulsion unit can be rotated about the axis of rotation relative to the stern of the craft, the second bracket having a bore extending therethrough, end fittings engaging opposite ends of the bore in the second bracket, the end fittings each having an opening, a cable tube extending through the openings, a cable being reciprocatingly received within the tube, the cable being operatively connected to the propulsion unit for steering the craft, wherein the cable is coaxial with the axis of rotation, wherein the second bracket has an actuator portion, the bore extending through the actuator portion, wherein the actuator portion has a cylindrical bushing surface, the first bracket having an extension, said extension having a cylindrical bore rotatably receiving the bushing surface, the bushing surface and the cylindrical bore being coaxial with the axis of rotation, and wherein the steering apparatus includes a pair of first brackets, the actuator portion having a pair of spaced apart cylindrical bushing surfaces, each of the first brackets having an extension with a cylindrical bore rotatably receiving one of the bushing surfaces.

9. The steering apparatus as claimed in claim 8, wherein the bushing surfaces and the cylindrical bores are coaxial with the axis of rotation.

10. The steering apparatus as claimed in claim 9, including seals between the end fittings and the bore in the second bracket.

11. The steering apparatus as claimed in claim 10, including seals between the openings in the end fittings and the cable tube.

* * * * *